United States Patent [19]

Salansky

[11] Patent Number: 4,621,812

[45] Date of Patent: Nov. 11, 1986

[54] INSTALLATION FOR THE TRANSPORT OF TENNIS BALLS

[75] Inventor: Werner Salansky, Vienna, Austria

[73] Assignee: Stabeg Apparatebaugesellschaft m.b.h., Vienna, Austria

[21] Appl. No.: 673,759

[22] PCT Filed: Feb. 16, 1984

[86] PCT No.: PCT/AT84/00006

§ 371 Date: Oct. 12, 1984

§ 102(e) Date: Oct. 12, 1984

[87] PCT Pub. No.: WO84/03222

PCT Pub. Date: Aug. 30, 1984

[30] Foreign Application Priority Data

Feb. 23, 1983 [AT] Austria ..... 610/83

[51] Int. Cl.[4] ..... A63B 69/40

[52] U.S. Cl. ..... 273/29 A

[58] Field of Search ..... 273/29 A, 26 A, 127 R, 273/176 K, 201, 181 K, 182 R, 35

[56] References Cited

U.S. PATENT DOCUMENTS

| | | | |
|---|---|---|---|
| 1,584,093 | 5/1926 | Harris | 273/176 K |
| 3,195,898 | 7/1965 | Respini | 273/26 A |
| 3,602,506 | 8/1971 | Gentiluomo | 273/176 K |
| 4,082,271 | 4/1978 | Martin | 273/26 A |
| 4,206,916 | 8/1980 | Epply | 273/26 A |
| 4,275,883 | 6/1981 | Grimaldi | 273/26 A |

*Primary Examiner*—Richard C. Pinkham
*Assistant Examiner*—T. Brown
*Attorney, Agent, or Firm*—Kuhn Muller and Bazerman

[57] ABSTRACT

Installation for the transport of tennis balls having at least one substantially vertical bouncing wall as well as a collector gutter for the balls and arranged at the foot of the wall. The covering (1) of the bouncing wall (2) is simply attached to a pair of parallel flanges (6,6') of the frame and the lateral portions (8,8') connecting the flanges (6,6') move away from each other due to the pressure of the springs (7) which are arranged thereto.

2 Claims, 4 Drawing Figures

INSTALLATION FOR THE TRANSPORT OF TENNIS BALLS

BACKGROUND OF THE INVENTION

The present invention relates to a tennis-ball delivery system, said system having a rebound wall that is substantially vertical, and a ball-collection trough that is disposed at the base of said rebound wall; a ramp, having an ascending and a descending portion connecting the rebound wall to the playing area, the rebound wall or ramp, respectively, having a frame with a flexible covering consisting of pipe sections that are inserted into each other. Systems of this type are used to collect balls that a player has hit against the vertical rebound wall or the ramp, and then moves these balls to a delivery system that, in its turn, passes them to a container. A ball thrower is usually connected to this container. Within the collection trough, the balls may be moved by gravity alone as disclosed in DE-OS No. 23 34 849, or they may be moved by a conveyor belt as disclosed in EU-OS No. 0,043,886. Usually, tennis balls are moved from the end of the collection trough to the container through a flexible hose by a suction system that is disposed in the ball thrower. The further movement of the balls could also be by a vertical delivery system with a circulating conveyor belt, as is disclosed in DE-OS No. 23 34 849.

The covering on the vertical rebound wall or the ramps connected thereto, respectively, has been found to be critical for the proper functioning of the systems, or as a reason for deficient functioning. In order to achieve the desired mix of elasticity and damping, which leads to the ball falling into the collection trough with the minimum of residual energy and subsequently remaining therein, DE-OS No. 23 34 089 proposes the use of "elastic damping" material, and then stretching the material. There are no further details as to which materials display these characteristics. In this regard, the proposals advanced by U.S. Pat. No. 2,280,376 appear more realistic. This provides a series of oblique nets arranged in front of the rebound wall that is in the form of a net, these oblique nets preventing the ball played against the wall from rebounding. However, implementation of these proposals is costly and the durability of the nets is dubious.

DE-OS No. 1,428,841 discloses a covering that is secured to a frame by means of springs. This almost always returns a tennis ball to the playing area, thus simulating the return of the ball by an opponent. In contrast to this, the present invention arranges for a ball that has been played against the rebound wall to drop into the collection trough with the least possible residual energy and then remain therein, in any event after another contact with the ramp. This is solved only in part by the loosely suspended hangings according to PCT-OS No. 80/01650, which is what is desired in the context of the description contained therein. In the conventional device, the impacting balls are brought to approximately the same terminal velocity at which they rebound from a rigid rebound surface, relatively independently of their initial velocity.

However, GB-PS No. 1,223,579 attempts to intercept an impacting tennis ball so that it is not returned to the playing area. To this end, a capture net is secured to pivoting side arms that permit the whole net to swing away when struck by a ball. Such a structure is not only costly from the point of view of design and space requirements, but is also confined to vertical rebound walls.

SUMMARY OF THE INVENTION

According to the present invention there is provided a system for delivering tennis balls comprising an at least substantially vertical rebound wall, a collection trough for the balls disposed at the base of said wall, a ramp having an ascending and a descending portion leading to a playing area connected to said rebound wall, both the rebound wall and the ramp having frames provided with a covering and comprising sections of tubing that are inserted into each other, the covering of at least one of the rebound wall and the portions of the ramp being secured only to one pair of parallel edge rails of the associated frame, and side portions that join the edge rails being forced away from each other by the pressure of springs arranged therein.

Thus according to the present invention the covering on the rebound wall and/or at least one area of the ramp, is secured only to one pair of parallel edge rails of the associated frame, and the side portions that join the edge rails are forced apart by the pressure of springs disposed therein.

However, only pressure springs are added to conventional frame designs and a suitable strength for these can easily be established experimentally. If a ball now impacts on the covering, it has to put not only the covering, (as is the case in DE-A No. 1428841) but also the whole frame into motion and is thereby intercepted very softly, regardless of the type of covering that is involved.

In contrast to conventional systems the present invention allows the use of almost any material for covering the rebound wall, and this material can be selected from, for example, its wear resistance and ease of cleaning.

Since the widths within which the system according to the present invention will be used vary within very wide limits, it is desirable to produce the rebound wall and the ramps in standard-width units that can then be connected to each other. Since the ramp and the rebound wall are, in such a case, interrupted by side portions that are under spring pressure, it is desirable that the covering overlaps the outer edges of the edge rails that protrude beyond the plane of the frame. This will prevent the cover resting on the spring-tensioned side portions and balls rebounding undamped back into the playing area from these areas.

BRIEF DESCRIPTION OF THE DRAWING

The present invention will be further illustrated by way of the accompanying drawings, in which.

DESCRIPTION OF THE PREFERRED EMBODIMENT

Figure 1:
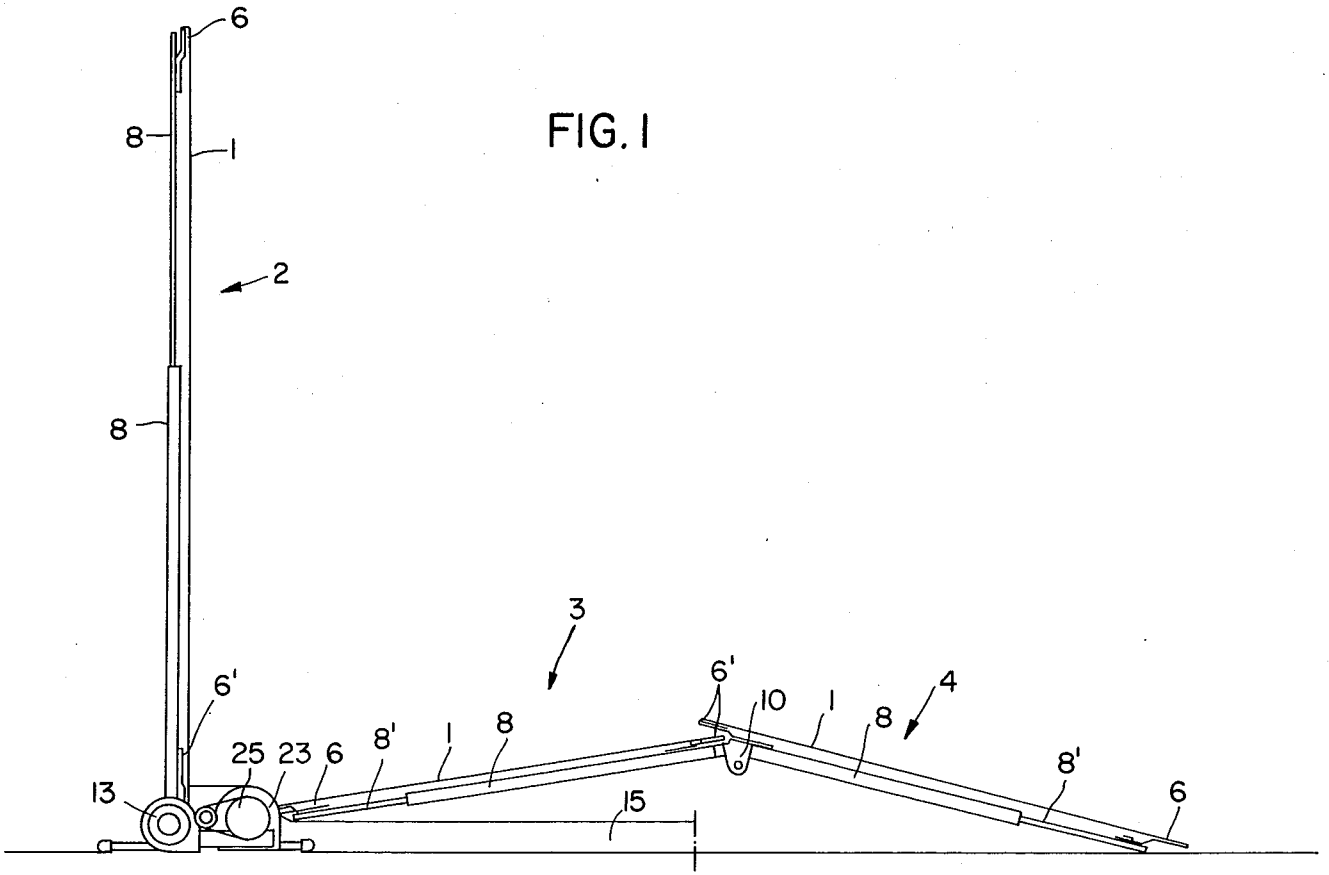
FIG. 1 is a side view of a system for collecting tennis balls according to one embodiment of the present invention.
Figure 2:
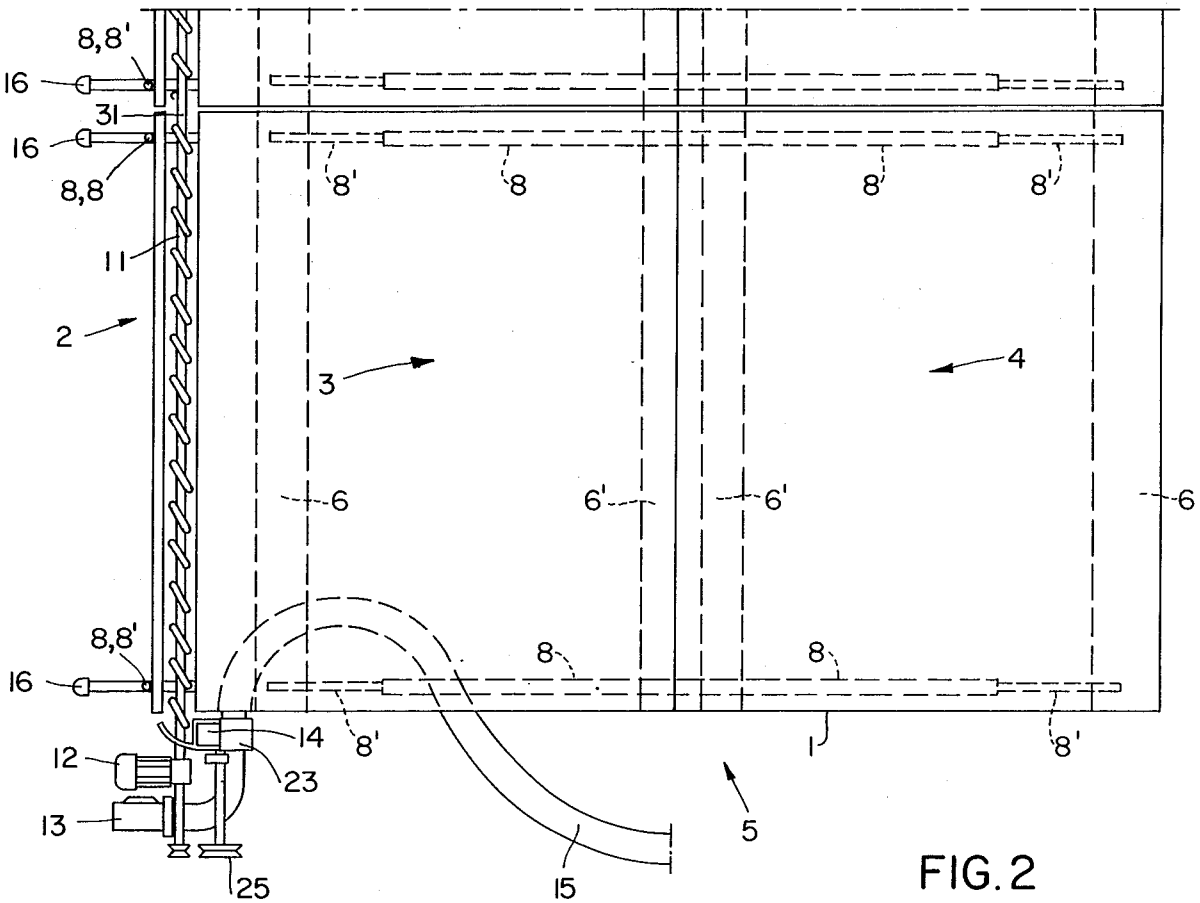
FIG. 2 is a plan view of the system in FIG. 1.

As shown in FIGS. 1 and 2, the system comprises a rebound wall 2 supported by stands 16. The rebound wall 2 is vertical or substantially vertical and, like the ramp 5, that has an ascending portion 3 and a descending portion 4, is provided with a covering 1. This covering passes between edge rails 6 and 6' which are kept apart by the telescoping side portions 8, 8'.

Figure 4:
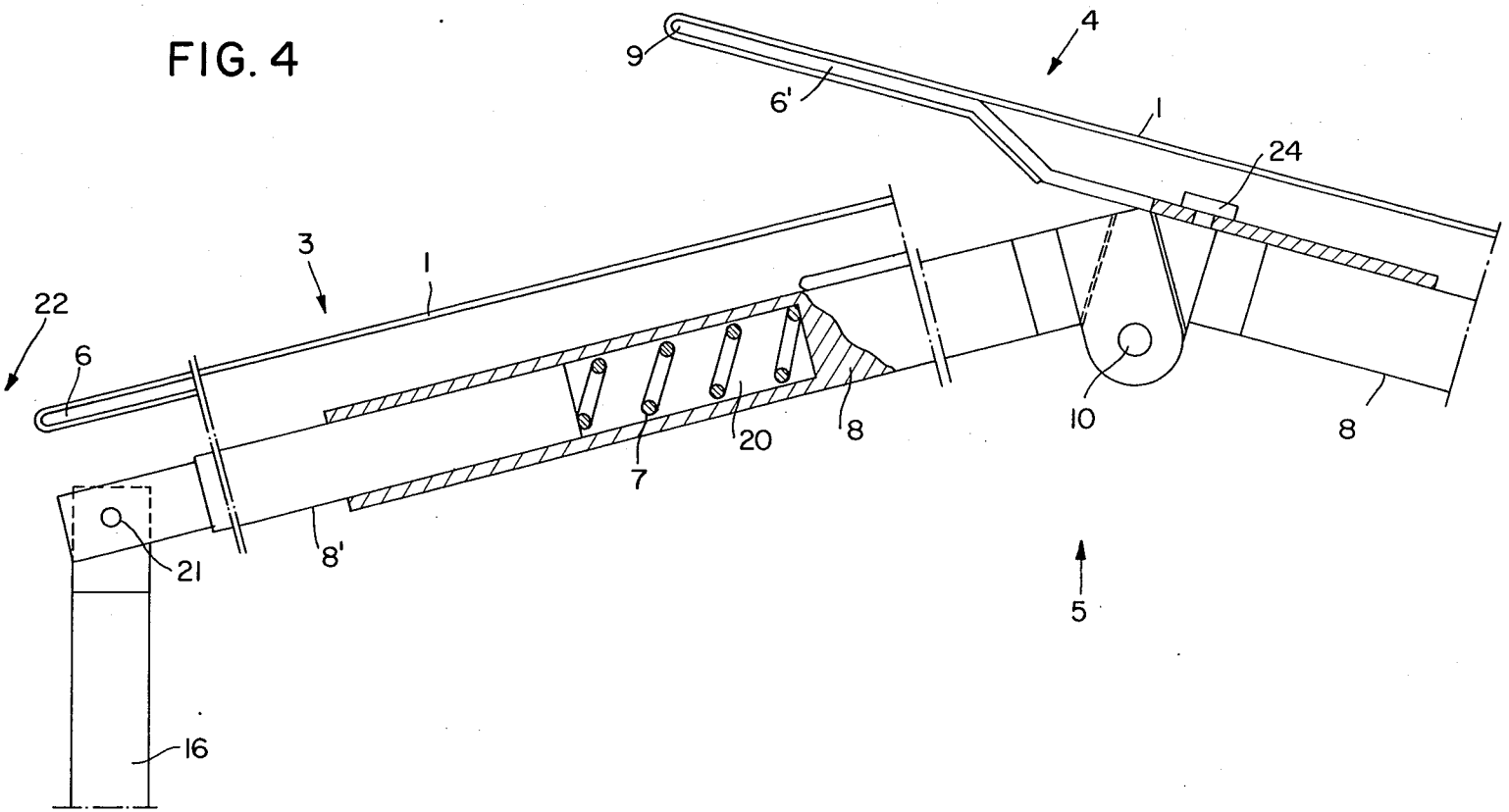

A hinge 10 having means well known in the art maintains the ramp 5 in the position shown in FIG. 4 so that a collection trough 22 is formed between the ramp 5 and the rebound wall 2. The tennis balls 17 are moved through this collection trough by a screw conveyor 11 to an outlet housing 23, into which they are moved by means of a paddle wheel 14. The paddle wheel 14 is powered via a transfer gearbox 25 by the same electric motor 12 that drives the screw conveyor 11. The tennis balls are forced by a fan from the outlet housing 23 into the hose 15, along which they move to a collection device, for example, a ball thrower (not shown).

As can be seen particularly from FIG. 2, both the rebound wall 2 and the ramp 5 are built up from individual parts to be arranged side by side. This makes the whole assembly easy to move, and makes it possible to assemble the system from prefabricated elements to form various widths. A single delivery system will suffice to move the tennis balls 17. The screw conveyor 11 is, however, provided with coupling points 31 that make it possible to assemble screw conveyors of any length.

Figure 3:
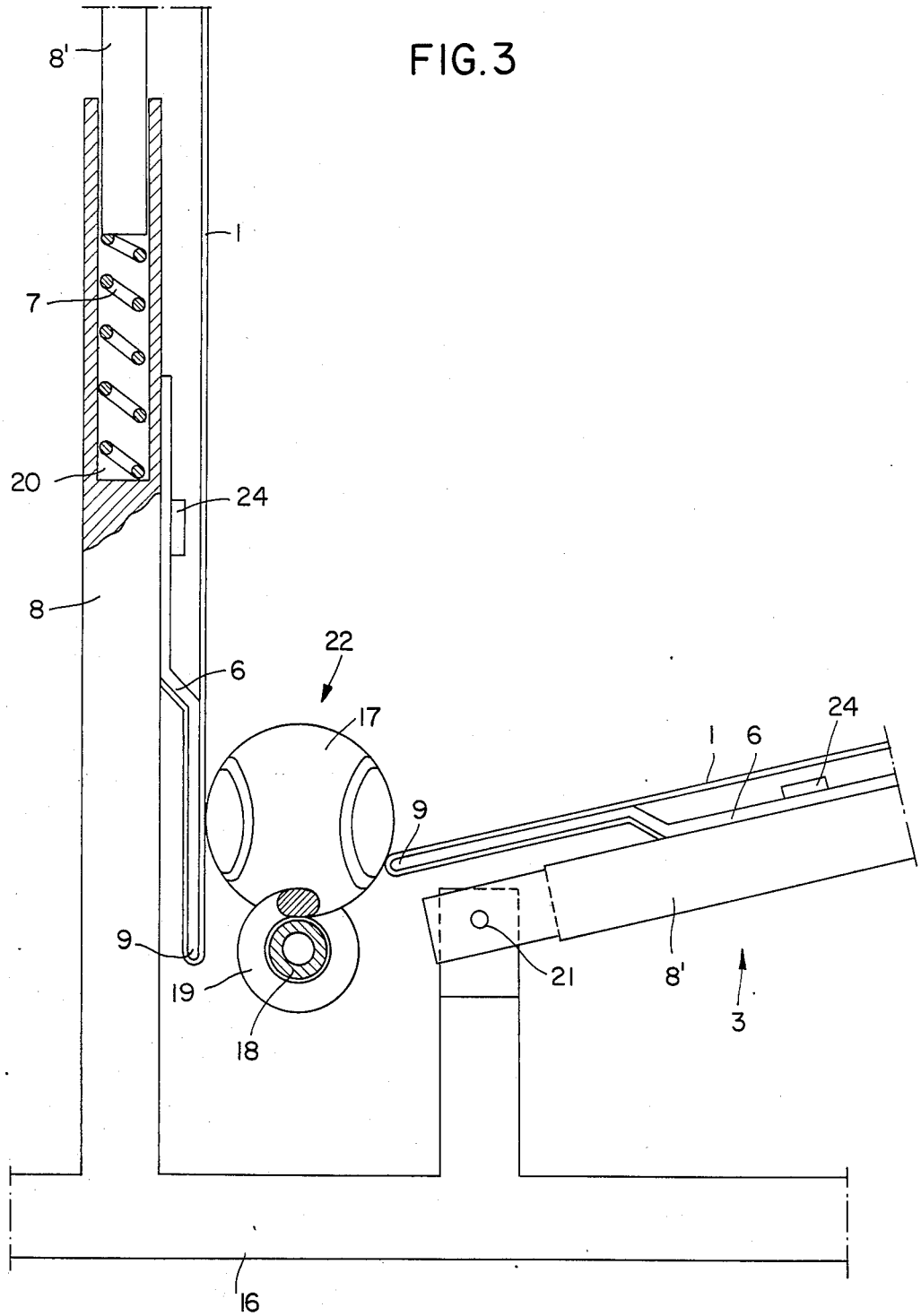
FIGS. 3 and 4 are partial cross-sections of enlarged side views.

The manner in which the covering 1 is secured to the rebound wall 2 or the products 3 and 4, is shown in greater detail in FIGS. 3 and 4. As can be seen, springs 7 are disposed between the side portions 8 and 8' that together with the edge rails 6,6' form a frame (as shown in FIG. 2), said springs resting in blind holes 20 within the outer side portions 8. The pressure of the springs 7 ensures that the covering 1 is under elastic tension between the edge rails 6, 6'. This elastic tension depends not on the material of the covering 1, but on the tension of the selected springs 7. The edge rails 6,6' are bent so that their outer edge 9 is spaced from the side portions 8,8', respectively, to which they are secured by means of the screws 24, or the like.

The rebound wall 2 and the ramp 5 determine the shape of the collection trough 22 (as shown in FIG. 3), on the base of which the tennis balls 17 lie, while they are moved by a screw conveyor 11, comprising an inner tube or rod 18 and a helix 19.

Since the ramp 5 is secured to stands 16 by means of a hinge 21, and since, in addition, there is a hinge 10 between the ascending portion 3 and the descending portion 4 of the ramp, the ramp can be folded very easily in order to save space when the system is not in use. However, a particular advantage of the arrangement is that the elasticity of the ramp 5, which results from the springs 7 can prevent damage to the ramp 5 itself if this is not folded up and a user steps onto the covering 1.

I claim:

1. A system for delivering tennis balls comprising an at least substantially vertical rebound wall, a collection trough for the balls disposed at the base of said wall, a ramp having an ascending portion extending from said trough and a descending portion leading from the upper end of said ascending portion to a playing area, said ramp being connected to said rebound wall by a support frame, both the rebound wall and the ramp having frames provided with a covering each of said frames being comprised of a pair of spaced apart substantially parallel side members and a pair of spaced apart substantially parallel edge rails defining a plane, said side members each being comprised of telescoping tubular members and said edge rails extending between and connecting the ends of said side members, said covering being secured only to said edge rails, each of said telescoping side members being longitudinally forced away from each other by the pressure of a spring means arranged therein to thereby tension said covering.

2. A system according to claim 1, in which a portion of said edge rails is spaced from side members, said covering being wrapped around said rail portion such that said covering is spaced from said side members in a plane different from the plane defined by said side members, said covering is spaced from said side portions.

* * * * *